US010238193B2

(12) United States Patent
Echelman

(10) Patent No.: US 10,238,193 B2
(45) Date of Patent: Mar. 26, 2019

(54) HANDBAG ARRANGEMENT WITH INTERCHANGEABLE COVER

(71) Applicant: Calin NYC, LLC, Brooklyn, NY (US)

(72) Inventor: Allison Echelman, Brooklyn, NY (US)

(73) Assignee: CALIN NYC, Brooklyn, NY (US)

( * ) Notice: Subject to any disclaimer, the term of this patent is extended or adjusted under 35 U.S.C. 154(b) by 0 days.

(21) Appl. No.: 15/684,571

(22) Filed: Aug. 23, 2017

(65) Prior Publication Data

US 2018/0055164 A1 Mar. 1, 2018

Related U.S. Application Data

(60) Provisional application No. 62/378,855, filed on Aug. 24, 2016.

(51) Int. Cl.
*A45C 3/08* (2006.01)
*A45C 13/08* (2006.01)

(52) U.S. Cl.
CPC ..... *A45C 3/08* (2013.01); *A45C 13/08* (2013.01)

(58) Field of Classification Search
CPC ..... A45C 3/08; A45C 13/08
USPC ..... 150/105
See application file for complete search history.

(56) References Cited

U.S. PATENT DOCUMENTS 1,960,396 A 3/1934 Rosenberg
1,990,360 A * 2/1935 Anish ..... A45C 13/08 150/105
2,118,400 A 4/1936 Goldberg
2,428,682 A 10/1947 Rhodes
2,609,854 A * 9/1952 Rosen ..... A45C 3/08 150/104
2,723,696 A * 11/1955 Kase ..... A45C 13/08 150/104
2,809,685 A 10/1957 Lowy
5,503,204 A * 4/1996 Byers ..... A45C 3/08 150/103
8,684,053 B2 4/2014 Platt et al.
2006/0237107 A1* 10/2006 Speck ..... A45C 1/06 150/131
2006/0266452 A1* 11/2006 Huie ..... A45C 3/08 150/105
2007/0209742 A1 9/2007 Morgan
2009/0194541 A1* 8/2009 Mayo ..... A45C 3/08 220/495.06
2010/0218863 A1 9/2010 Church et al.
2012/0125496 A1* 5/2012 Hedaya ..... A45C 3/08 150/104
2012/0192331 A1* 8/2012 Fowler ..... A45C 13/001 2/12

* cited by examiner

*Primary Examiner* — Sue A Weaver
(74) *Attorney, Agent, or Firm* — Gottlieb, Rackman & Reisman, PC

(57) ABSTRACT

A handbag with interchangeable covers that alter the overall look of the handbag. This allows users to customize the aesthetics of the bag and have multiple looks without having to purchase an entirely new handbag. The insert has a zipper enclosure and inner pocket. The outer covers can be made from a variety of materials and securely attach to the insert, fully enveloping it. The two pieces are easily attached by fastening the pegs located on the top of the cover with corresponding holes located on the top of the insert.

2 Claims, 12 Drawing Sheets

HANDBAG ARRANGEMENT WITH INTERCHANGEABLE COVER

CROSS-REFERENCE TO RELATED APPLICATION

This patent application claims benefit under 35 U.S.C. § 119 to U.S. Provisional Patent Application No. 62/378,855, filed Aug. 24, 2016, which is hereby incorporated by reference in its entirety as part of the present disclosure.

FIELD OF THE INVENTION

The present invention relates to handbags and more particularly to methods and functionality of interchangeable covers that alter the aesthetic of the handbag.

BACKGROUND OF THE INVENTION

Handbags can be functional items but they are also essential additions to an outfit. Many people own more than one handbag and use them to enhance and add to their wide variety of outfits. People also use different handbags depending on the activity, occasion or destination. For example, a handbag worn in a work setting tends to be different than one would wear to dinner or going to the beach. While many people desire to own different handbags, ones of high quality tend to be very costly, which can hinder someone from purchasing multiple handbags.

The desire to use more than one handbag for different occasions can also be challenging logistically. For instance, when travelling and space is limited, packing multiple bulky handbags is not ideal. It is also a nuisance to switch all items from one bag to another when using multiple bags, sometimes causing items to be lost or left behind.

While there are several other bags that provide interchangeable covers, none provide the convenience, and practical nature of this particular invention. For example, many other bags have fastenings that include magnets, which can overtime lose their magnetism and ability to hold the pieces together. Other iterations include fastenings with hooks, buttons, flaps and snaps, all which can be fussy and inconvenient to use.

SUMMARY OF THE INVENTION

The present invention is directed to an improved means of conveniently and cost-effectively altering the look of a handbag with interchangeable covers. The ability to easily change the covers allows the user to customize their handbag and have flexibility and control over their look without spending an inordinate amount of money for an entirely new handbag. In addition, by using the same insert bag within many different covers, it prevents people from having to switch items inside the bag from one bag to the next.

Thus, the primary object of the present invention is to provide a handbag arrangement including an exterior cover and an interior insert, whereby the cover is attachable to the insert and may be readily detached and removed from the insert and then inserted into a different cover, allowing a user to present multiple looks without the need of purchasing entirely new handbags.

BRIEF DESCRIPTIONS OF THE DRAWINGS

DETAILED DESCRIPTION OF EMBODIMENTS OF THE PRESENT INVENTION

Figure 1:
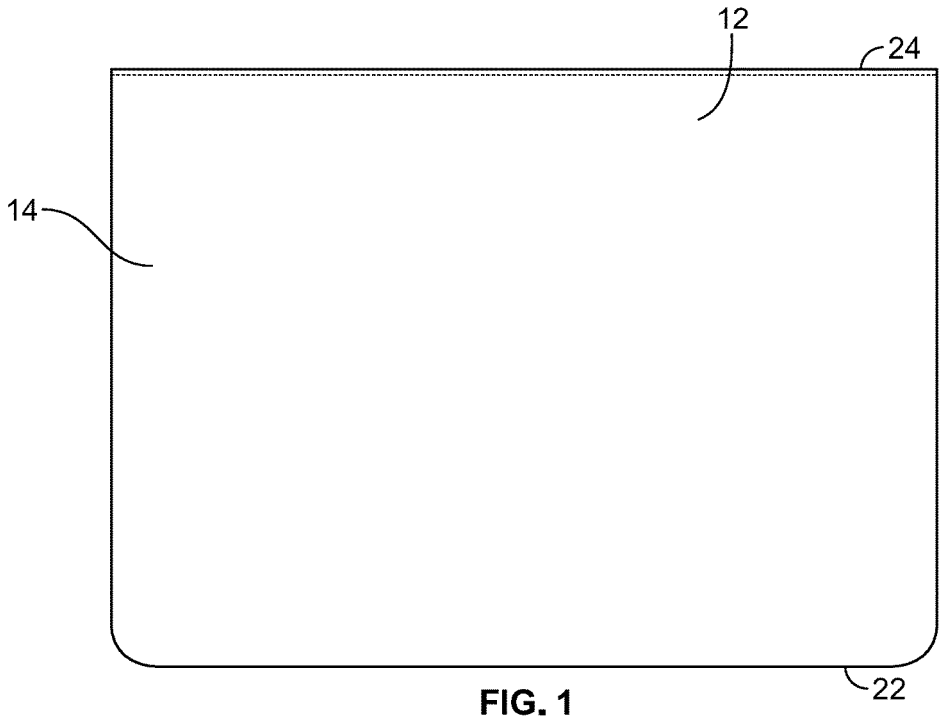
FIG. 1 is a front exterior view of an embodiment of a handbag cover of the present invention.
Figure 2:
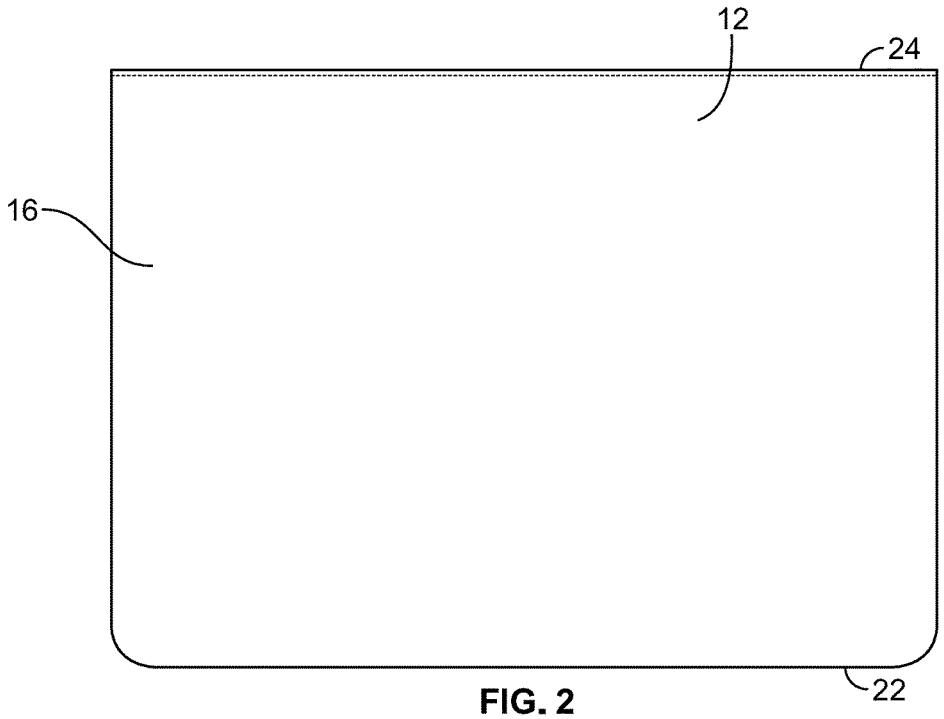
FIG. 2 is a rear exterior view of the handbag cover.
Figure 3:
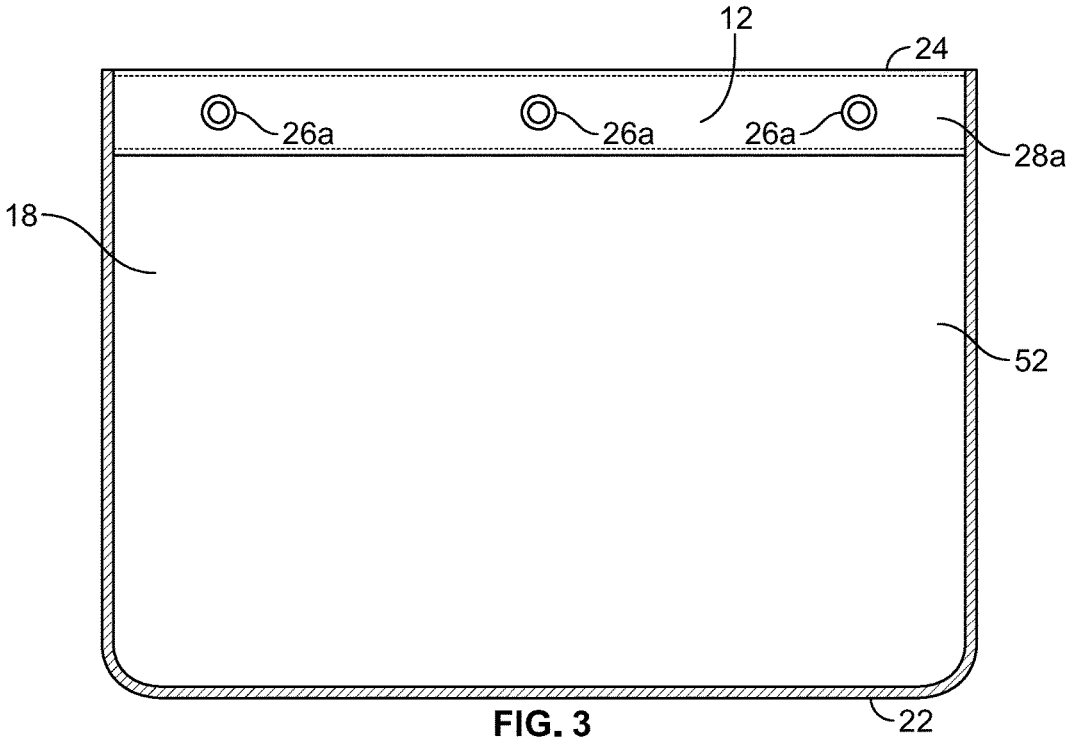
FIG. 3 is a front interior view of the handbag cover.
Figure 4:
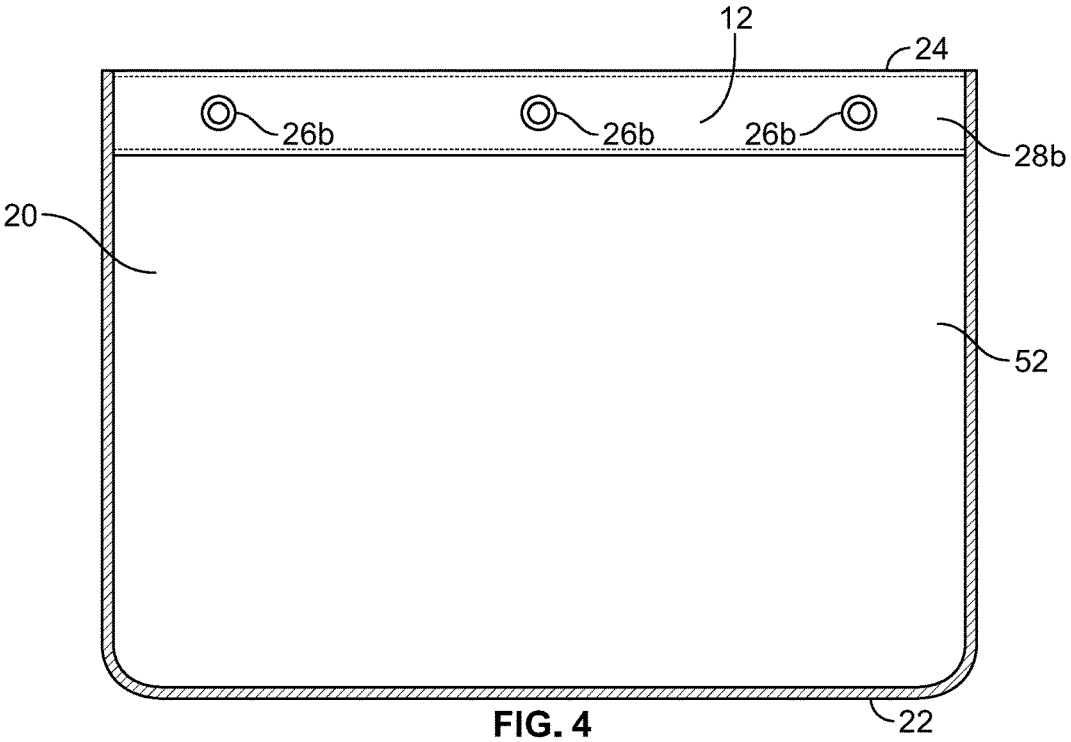
FIG. 4 is a rear interior view of the handbag cover.
Figure 5:
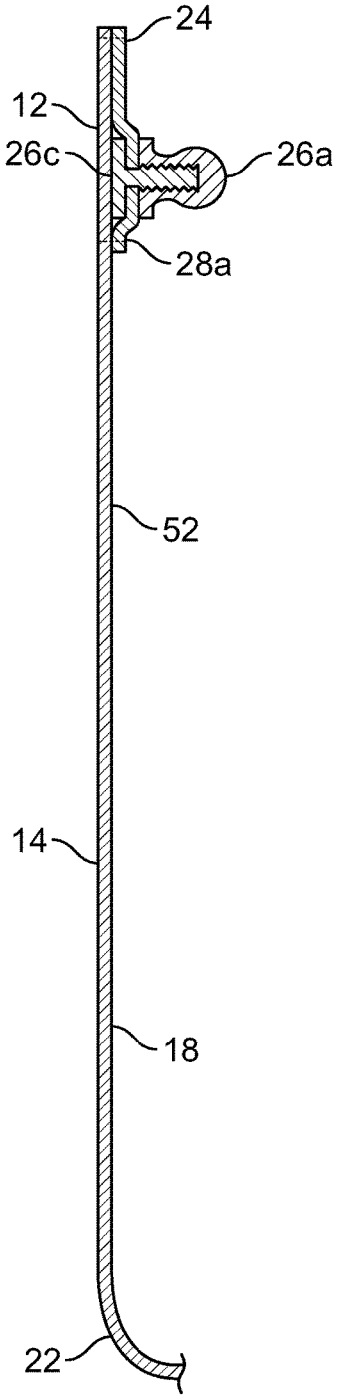
FIG. 5 is a cross-sectional view of the front of the handbag cover.
Figure 6:
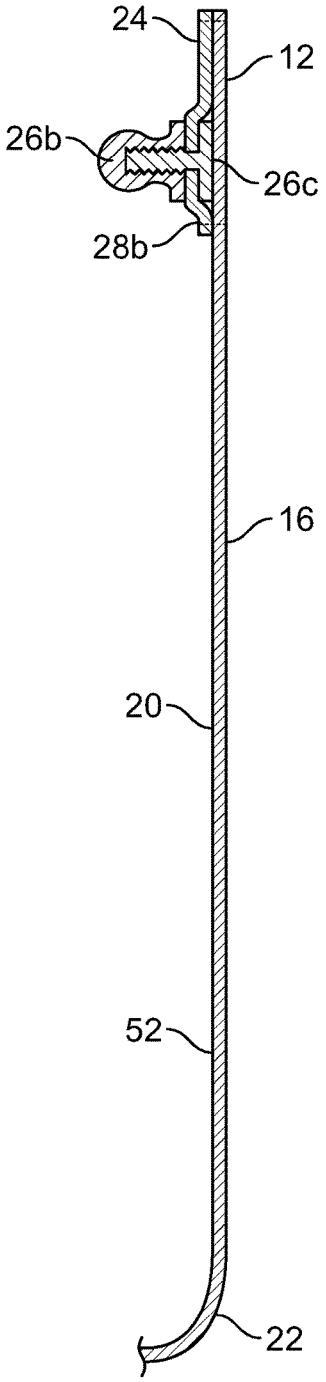
FIG. 6 is a cross-sectional view of the rear of the handbag cover.
Figure 7:
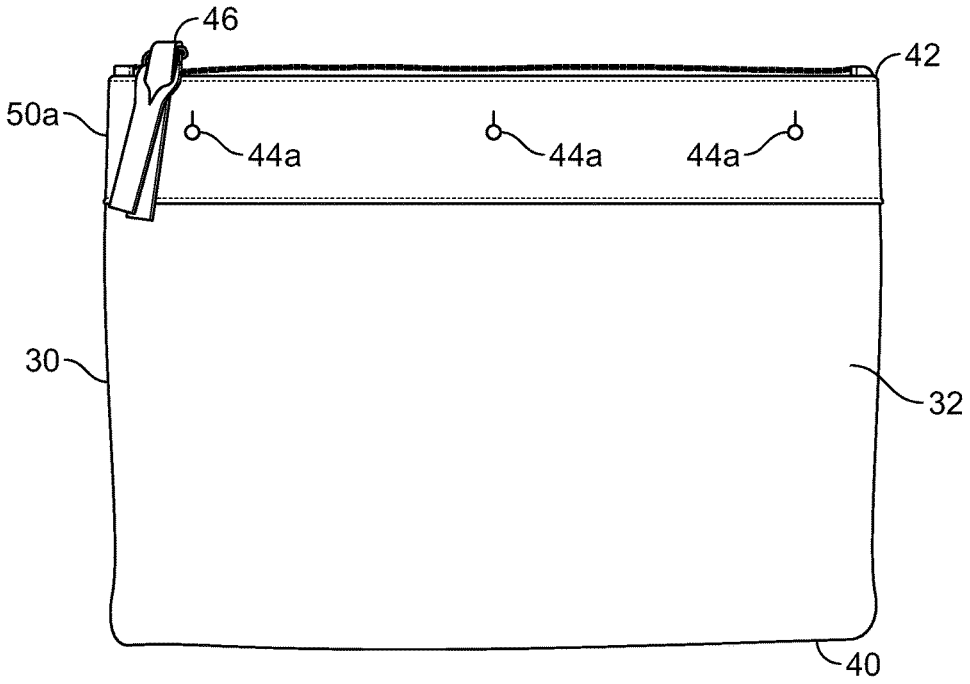
FIG. 7 is a front exterior view of an embodiment of a handbag insert of the present invention.
Figure 8:
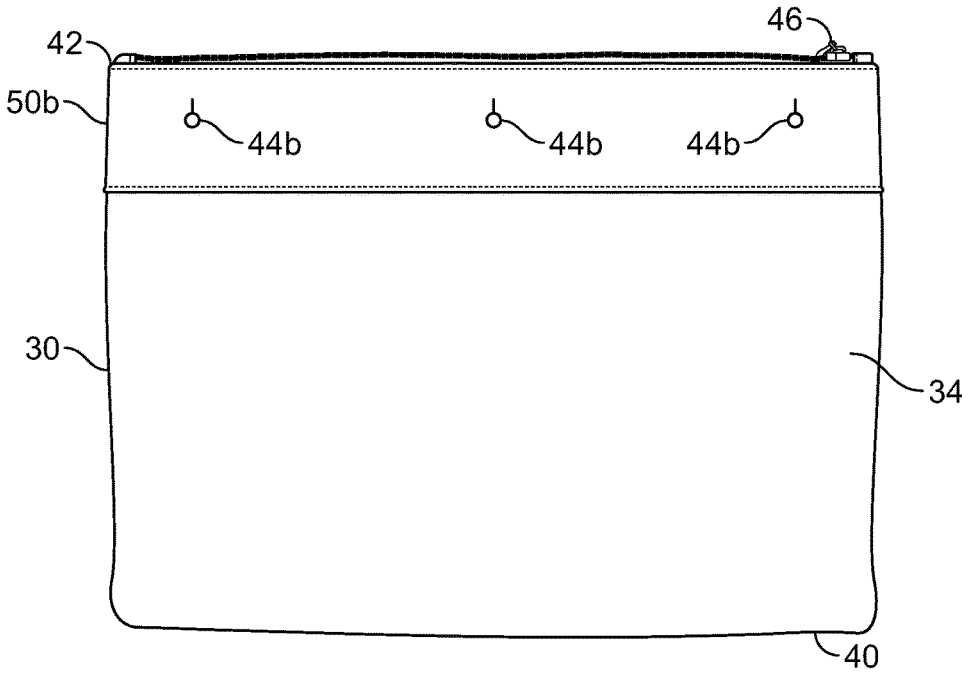
FIG. 8 is a rear exterior view of the handbag insert.
Figure 9:
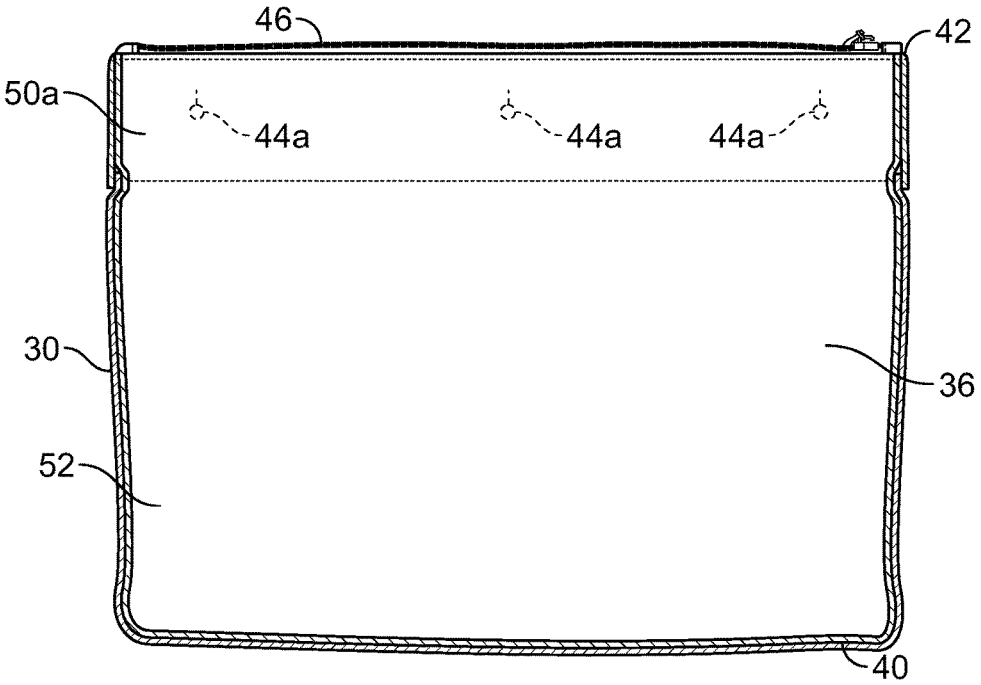
FIG. 9 is a front interior view of the handbag insert.
Figure 10:
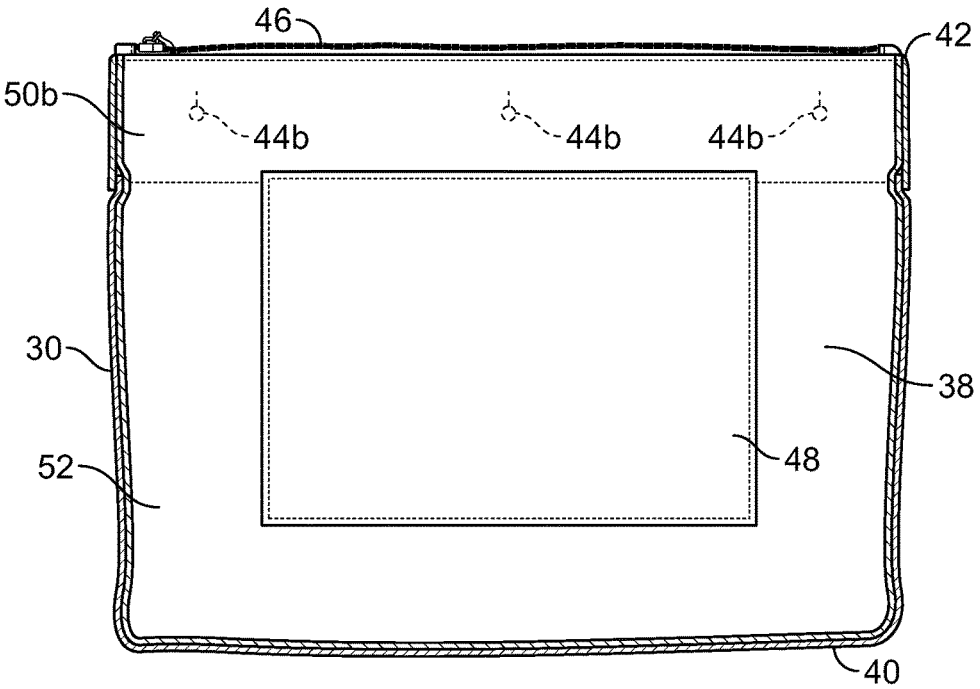
FIG. 10 is a rear interior view of the handbag insert.
Figure 11:
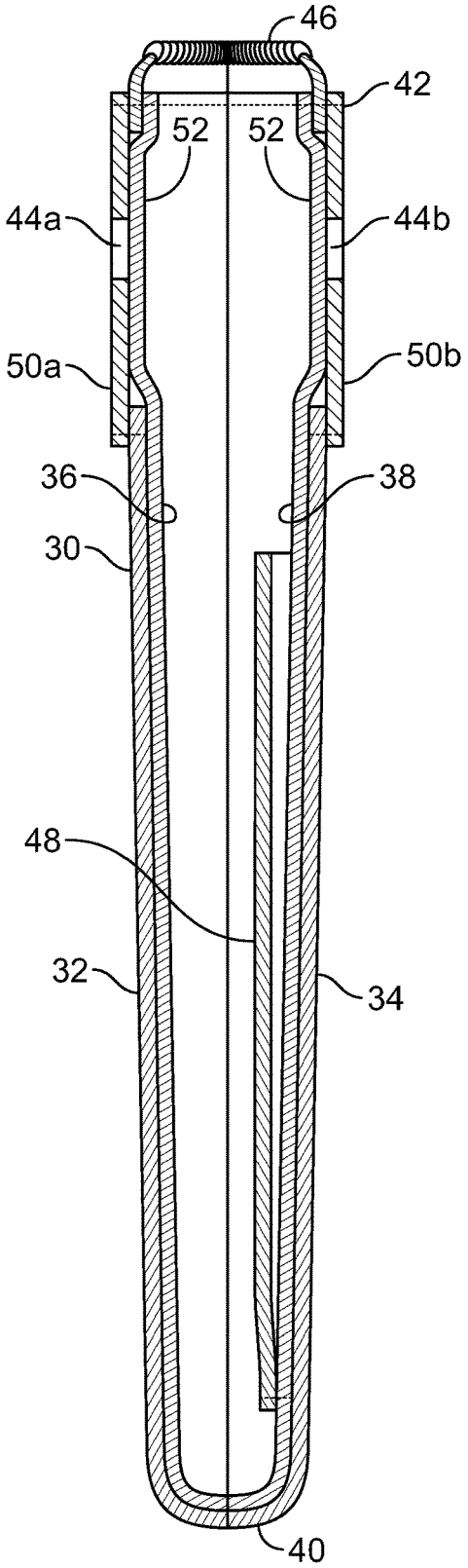
FIG. 11 is a cross-sectional view of the handbag insert.
Figure 12:
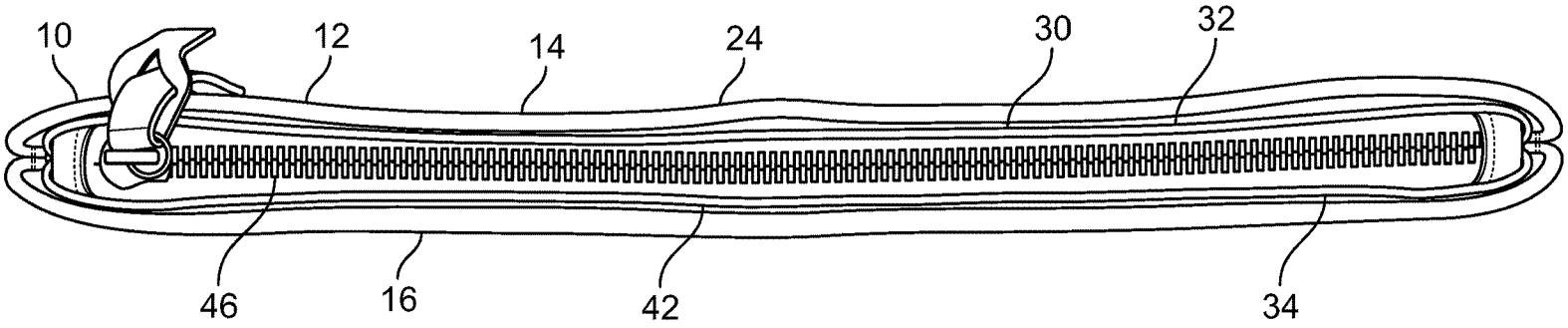
FIG. 12 is a top view of the handbag cover and handbag insert when combined.
Figure 13:
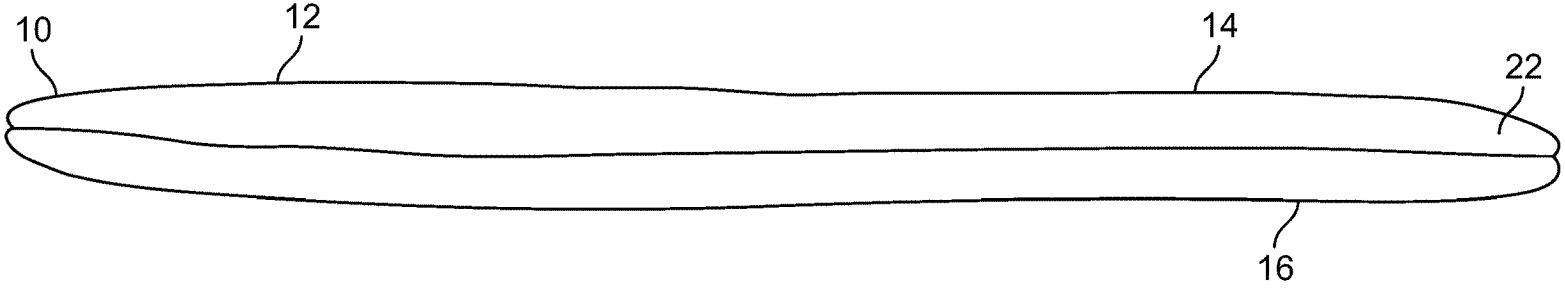
FIG. 13 is a bottom view of the handbag cover and handbag insert when combined.
Figure 14:
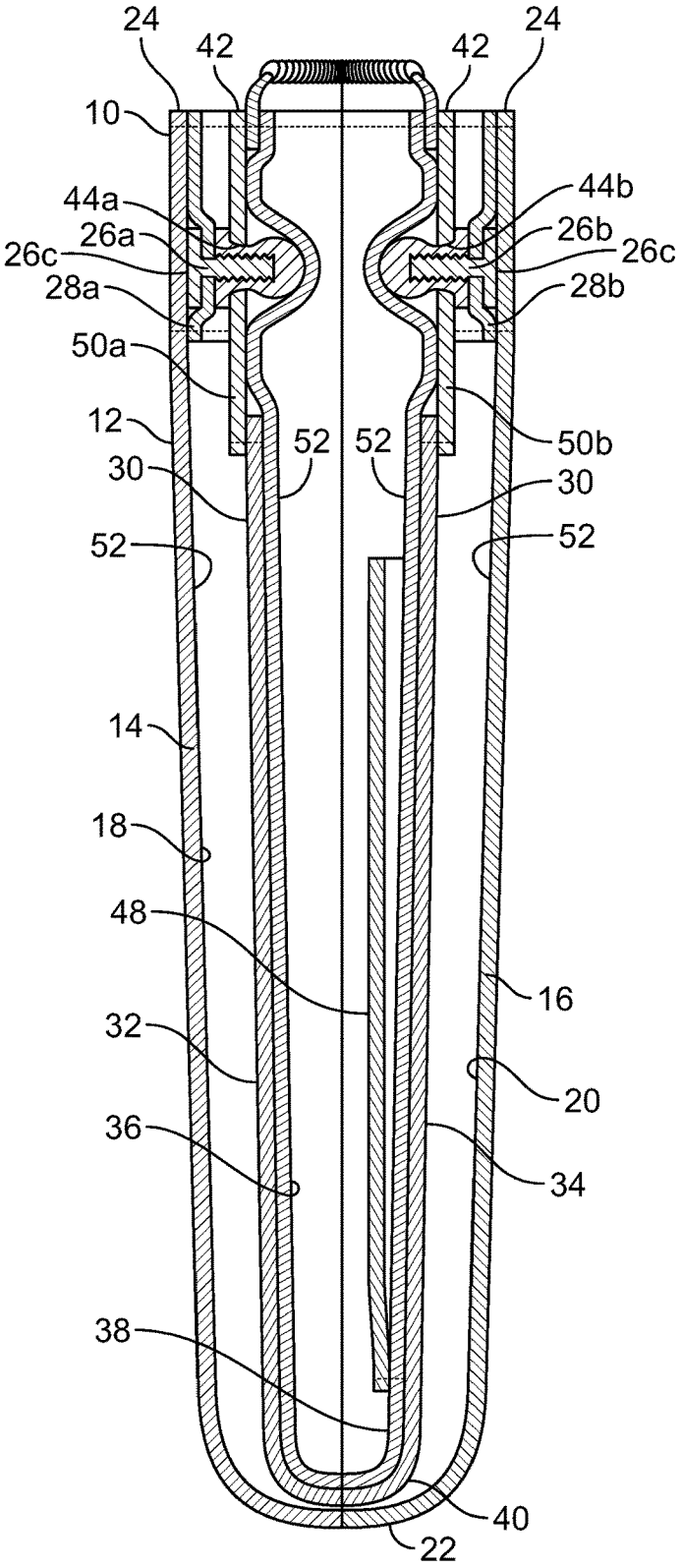
FIG. 14 is a cross-sectional view of the handbag cover and handbag insert when combined.
Figure 15:
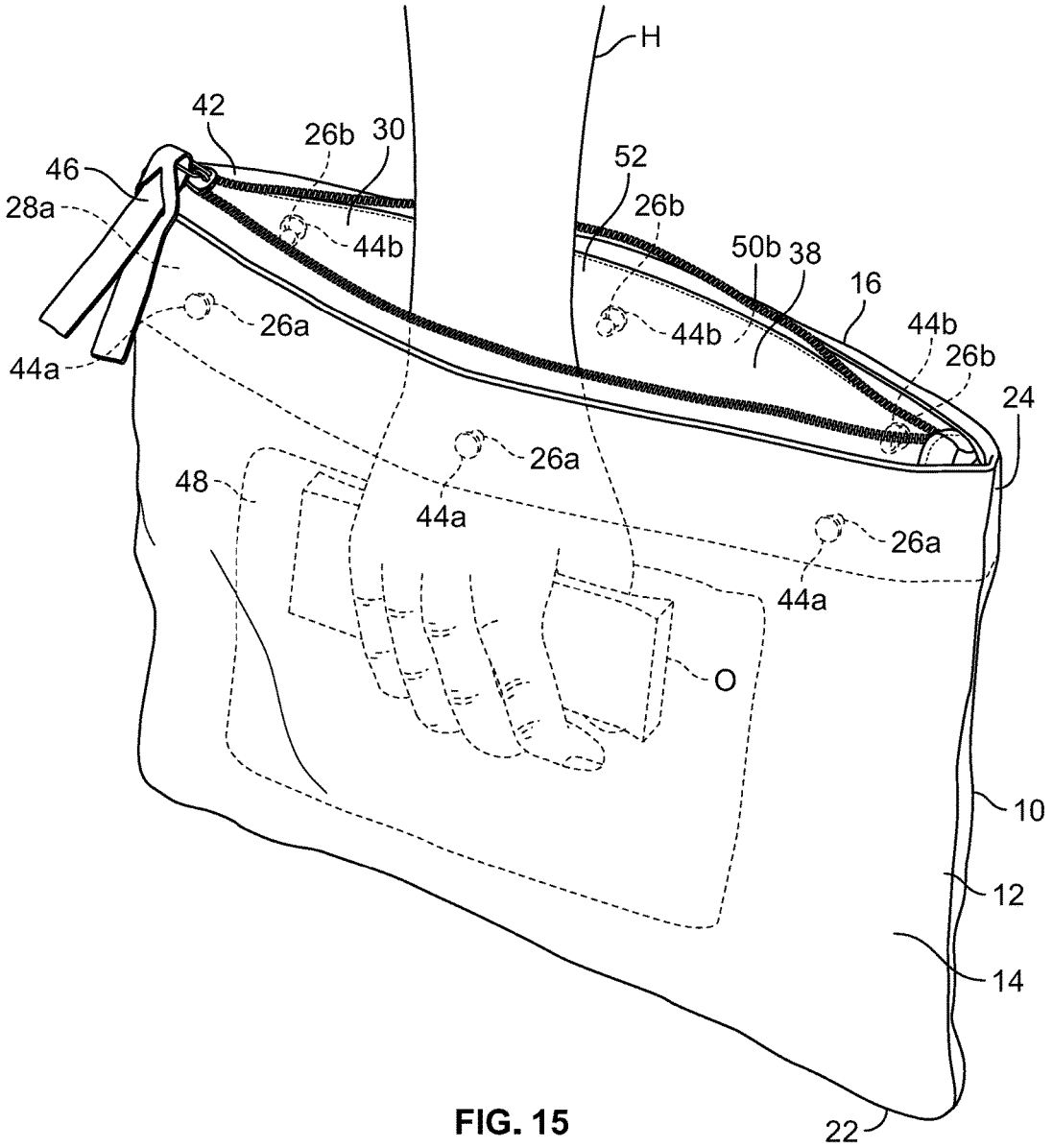
FIG. 15 depicts a hand reaching into the open handbag.

With reference now to the drawings, and in particular to FIGS. 1 through 18B, embodiments of a handbag which includes a cover and an insert embodying the principles and concepts of the present invention will be described.

FIGS. 1-6 illustrate an embodiment of a generally rectangular cover 12. The cover 12 can be made of a variety of materials that include, but are not limited to, leather, suede, acrylic, wood, plastic and fabric and can consist of many different patterns and textures, which are visible on a front exterior 14 and a rear exterior 16 of the cover 12. Users may own a variety of different covers 12 and interchange them as frequently as they would like, providing the user with the ability to completely customize the look of their handbag 10.

As can be seen, for example, in FIGS. 3-6, the insides of the covers 12 are lined with fabric 52 overlying the front interior 18 and rear interior 20 of the cover 12. For the sake of simplicity, the fabric 52 is not shown separately from the cover to which it is attached. The fabrics 52 and the covers 12 make up opposed faces of the cover. The interiors 18, 20 carry strips 28*a*, 28*b* located along their top edges 24 which are desirably made of a stiff material such as leather, fabric, acrylic or similar materials. The strips 28*a*, 28*b* each carry desirably three horizontally aligned pegs 26*a*, 26*b* that can be made of a variety of essentially non-elastic materials, such as metal, plastic or acrylic. As noted below, there also may be more or less than three pegs used with the same result, although three seem most desirable.

The pegs 26*a*, 26*b* correspond with the placement of three horizontally aligned mating holes 44*a*, 44*b* on the insert 30. For larger versions of the handbag 10 the amount of pegs 26*a*, 26*b* could increase to four pegs to effectively cover the length of the strips 28*a*, 28*b* and the number of holes 44*a*, 44*b* would increase to four as well. See FIG. 1 through FIG. 6 for details.

Figure 16B:
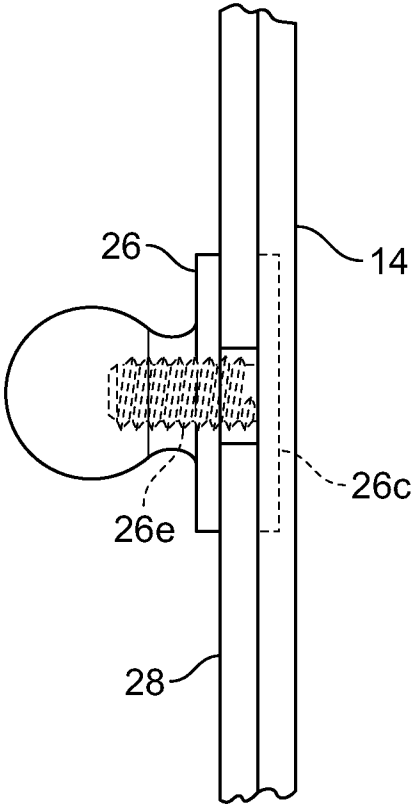
FIGS. 16A and 16B show an embodiment of a metal peg of the present invention being attached to the leather strip on the interior of the cover.
Figure 16A:
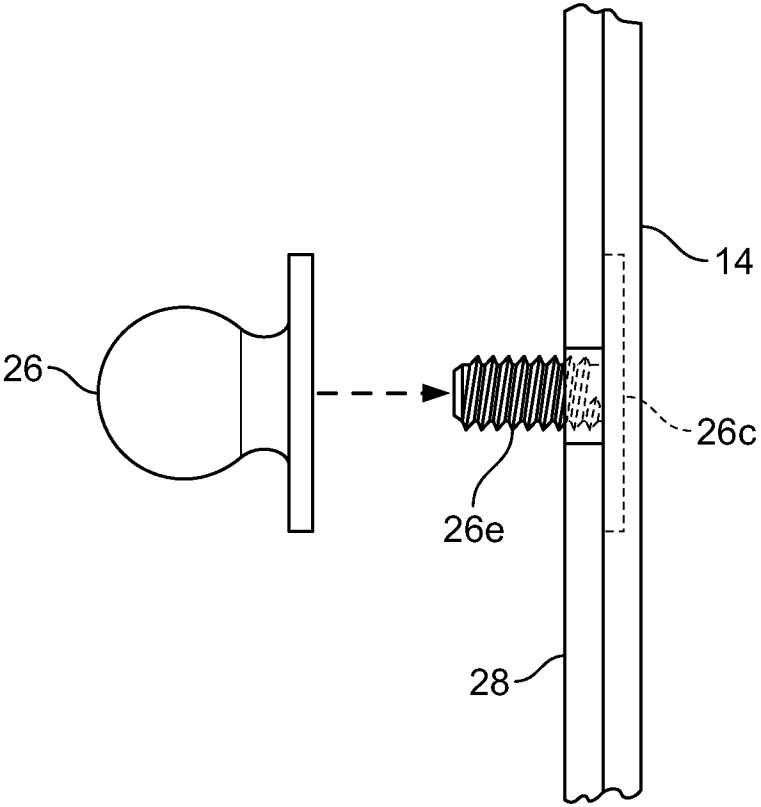
Figure 17:
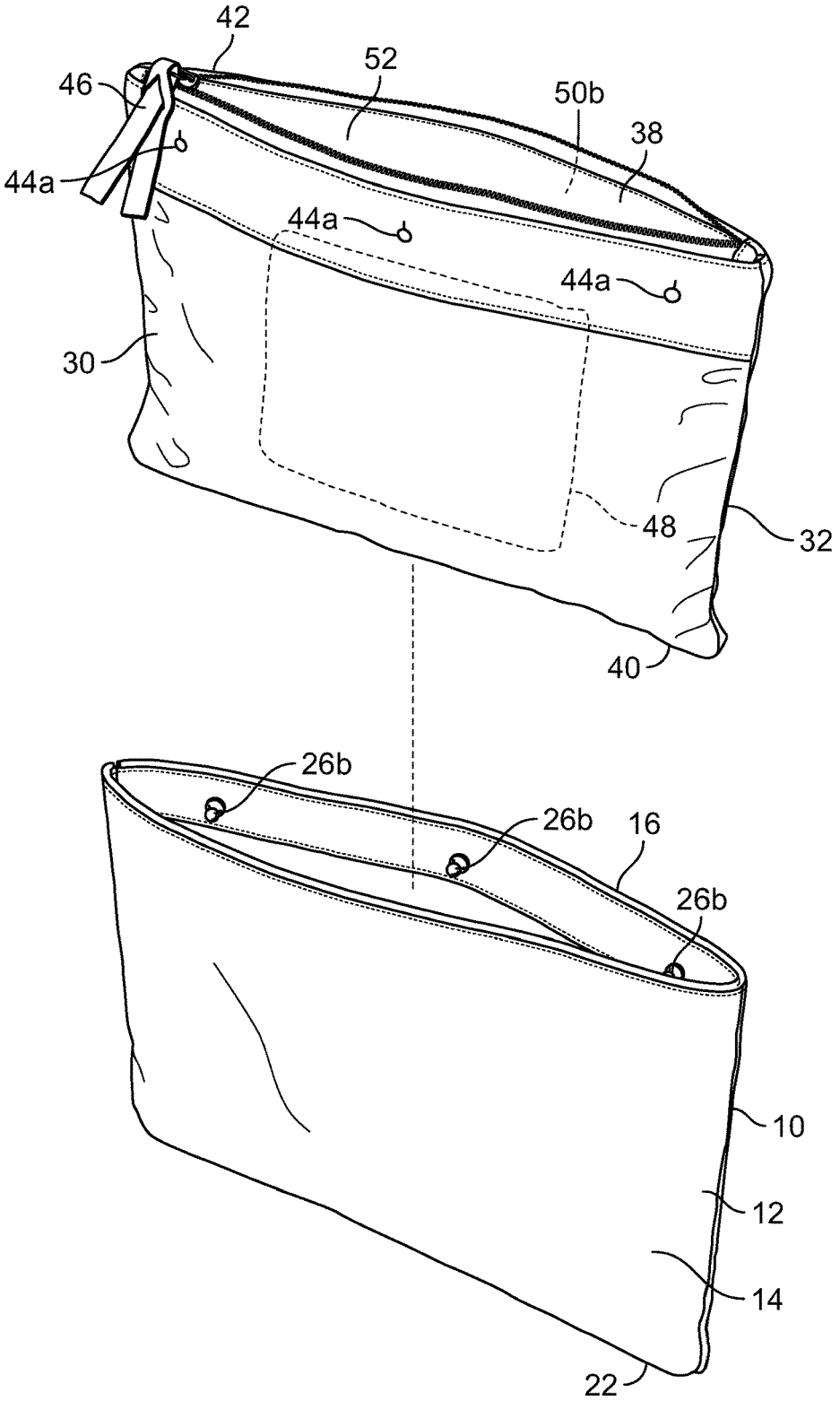
FIG. 17 is a perspective view showing the insert in alignment (being inserted or removed) with respect to the cover.

As illustrated in FIGS. 16A and 16B, the pegs 26 are fastened to the strips 28 by placing the screw back plate 26*c* of each peg 26 behind the strip 28 on the handbag cover in-between the cover exterior 14, 16 and cover interior 18, 20. The threaded post 26*e* of the screw of each peg is located through a hole in the strip 28 so that it is sticking out toward the cover interiors 18, 20. Each peg 26 is screwed onto its post 26*e* until they are secure against the strip 28 and its plate 26*c*. Other means well-known in the handbag art may be used for attaching the pegs 26 to the upper interiors of the cover.

The insert 30 is made of fabric and is rectangularly configured and of such dimensions, somewhat smaller than the interior dimensions of the cover that it can fit snugly into a cover 12. See FIG. 17. The insert on its front exterior face 32 and its back exterior face 34 carries strips 50*a*, 50*b* along its top edges 42. The strips are made of stiff material such as leather, fabric, acrylic or similar materials. On the insert front exterior 32 there are, as noted, small holes 44*a* along the strip 50*a* that go through to the insert front interior 36, which are part of the attachment mechanism. On the insert back exterior 34 there are small holes 44*b* along the strip 50*b* that go through to the insert back interior 38, which again are part of the attachment mechanism.

The insert 30 has a zipper 46 at its top, which closes the opening and serves as the main zipper for the overall handbag 10. Inside the insert is a pocket 48. See FIG. 7-FIG. 11 for details.

Figure 18B:
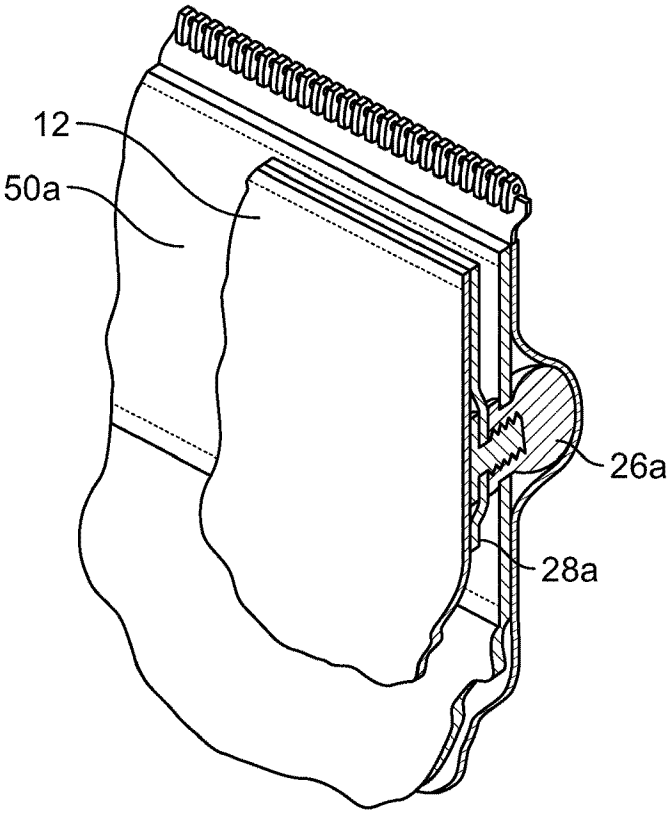
FIGS. 18A and 18B are detail views of the attachment between a cover and an insert.
Figure 18A:
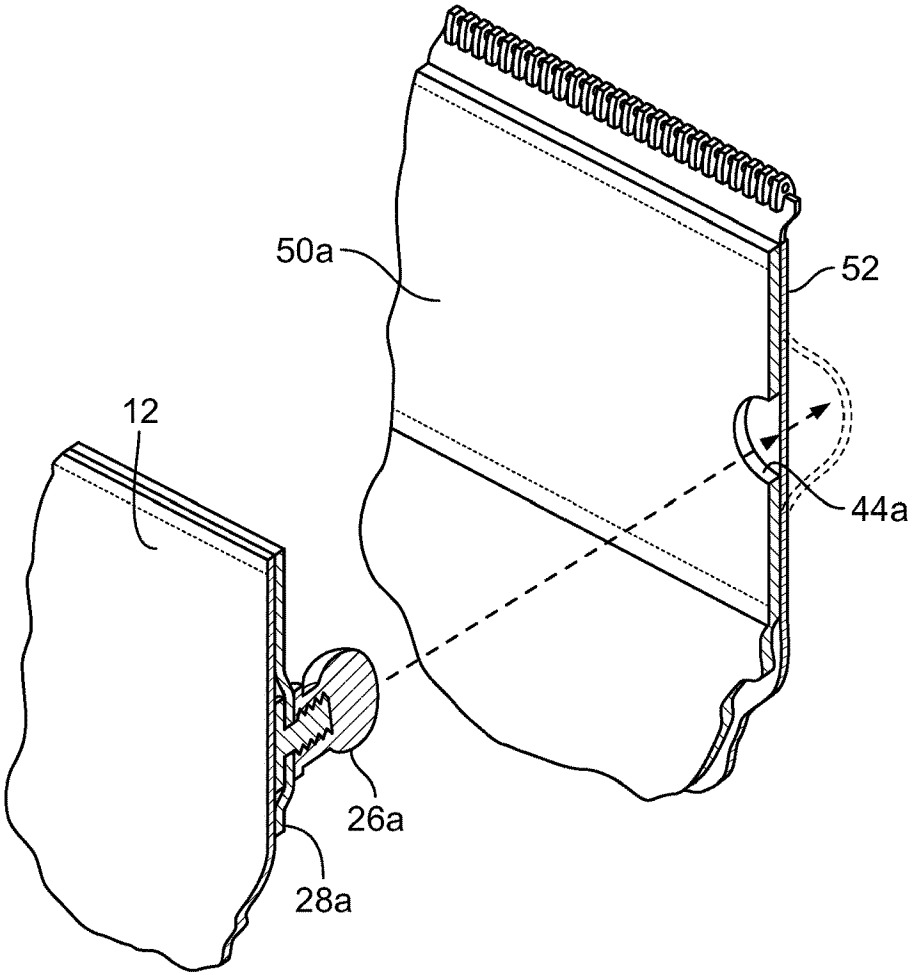

The pegs 26*a*, 26*b* on the cover 12 are meant to fit securely, but removably, into the holes 44*a*, 44*b* on the insert 30. The attachment of the cover 12 is effortless and simple. See FIGS. 14,18A and 18B. Specifically, each peg 26 has an enlarged, bulbous head that may be gently urged into a slightly smaller in diameter aligned hole 44, and slightly past the strip 50 and against the liner 52, whereby the peg head is temporarily trapped in place, until it is time to withdraw it in the opposite direction. Note that the bulge caused by the insertion of a peg 26*a* into and through an aligned hole 44*a* in FIGS. 18A and 18B is somewhat exaggerated, for the purpose of clarity.

The cover 12 easily slides over the insert 30 and completely encompasses it, whereby the bottom edge of the insert 40 rests on top of the bottom edge of the cover 22 fully altering the look of the overall handbag 10. Once the two pieces are fastened by the pegs 26*a*, 26*b*, they function as one unit and the zipper 46 on the insert 30 acts as the closure for the entire handbag 10. See FIG. 14 and FIG. 15 for details.

When the cover 12 encompasses the insert 30 and is securely attached, they act as one unit. Users can add items to the handbag 10 by placing them within the insert. See FIG. 15 for details, showing the hand H of a user grasping an object O in the interior pocket 48.

When the user decides to change the look of the handbag 10, the user simply has to change the cover. To do this, the user has to detach the cover 12 from the insert 30 by gently pulling one side of the cover 12 away from the corresponding side of the insert 30. This will detach the pegs 26 located on the cover 12 from the holes 44 in the insert. Repeat this process on the other side of the handbag. After selecting a new cover 12, the user will slip the cover 12 over the insert 30 and secure the pegs 26 on the cover 12 into the corresponding holes 44 on the insert 30. After doing this, the cover 12 will be securely fastened to the insert 30 and they will function as one unit.

The accompanying drawings illustrate an embodiment of handbag arrangement and its respective constituent parts, however, other types and styles are possible, and the drawings are not intended to be limiting in that regard. Thus, although the description above and accompanying drawings contains much specificity, the details provided should not be construed as limiting the scope of the embodiment, but merely as providing illustrations of some of the features of the embodiment. The drawings and the description are not to be taken as restrictive on the scope of the embodiment and are understood as broad and general teachings in accordance with the present invention. While the present embodiment has been described using specific terms, such description is for illustrative purposes only, and it is to be understood that modifications and variations to such embodiment, including, but not limited to, the substitutions of equivalent features, materials, or parts, and the reversal of various features thereof, may be practiced by those of ordinary skill in the art without departing from the spirit and scope of the invention.

What is claimed is:

1. A handbag arrangement, comprising:

a generally rectangular cover including a pair of interior opposed faces, each face carrying a number of interior-facing pegs along an upper portion thereof; and a generally rectangular insert having dimensions so as to be readily insertable into and removable from the cover and having a pair of exterior opposed faces and having a number of holes on each of its faces along an upper portion thereof, strips located on the interior opposed faces of the cover, the pegs being located on said strips and strips located on the exterior faces of the insert, the holes being located on said last-named strips;

the pegs being horizontally aligned and the holes being horizontally aligned, each peg including a back plate, a threaded post and a bulbous head;

the pegs and the holes being in alignment when the insert is within the cover with the pegs being insertable into and withdrawable from the holes;

wherein when the insert is within the cover and the pegs are placed through the holes, the cover and the insert are an integrated unit and when the pegs are withdrawn from the holes, the insert is removable from the cover.

2. A handbag arrangement, comprising:

a generally rectangular cover including a pair of interior opposed faces, each face carrying a number of interior-facing pegs along an upper portion thereof; and a generally rectangular insert having dimensions so as to be readily insertable into and removable from the cover and having a pair of exterior opposed faces and having a number of holes on each of its faces along an upper portion thereof, strips located on the interior opposed faces of the cover, the pegs being located on said strips and strips located on the exterior faces of the insert, the holes being located on said last-named strips;

the pegs and the holes being in alignment when the insert is within the cover with the pegs being insertable into and withdrawable from the holes;

the pegs being horizontally aligned and the holes being horizontally aligned, each peg including a back plate, a threaded post and a bulbous head, the back plates of the pegs being located between the strips and the cover faces;

wherein when the insert is within the cover and the pegs are placed through the holes, the cover and the insert are an integrated unit and when the pegs are withdrawn from the holes, the insert is removable from the cover.

* * * * *